US011306732B2

(12) United States Patent
Xu

(10) Patent No.: US 11,306,732 B2
(45) Date of Patent: Apr. 19, 2022

(54) CENTRIFUGAL IMPELLER AND CENTRIFUGAL FAN COMPRISING THE SAME

(71) Applicant: Zhongshan EBS Technology Co., Ltd., Zhongshan (CN)

(72) Inventor: Haiming Xu, Zhongshan (CN)

(73) Assignee: ZHONGSHAN EBS TECHNOLOGY CO., LTD., Zhongshan (CN)

( * ) Notice: Subject to any disclaimer, the term of this patent is extended or adjusted under 35 U.S.C. 154(b) by 0 days.

(21) Appl. No.: 17/027,666

(22) Filed: Sep. 21, 2020

(65) Prior Publication Data

US 2021/0003143 A1 Jan. 7, 2021

Related U.S. Application Data

(63) Continuation-in-part of application No. PCT/CN2019/104617, filed on Sep. 6, 2019.

(30) Foreign Application Priority Data

Jan. 12, 2019 (CN) ..... 201910028924.5
Jan. 12, 2019 (CN) ..... 201920048794.7

(51) Int. Cl.
*F04D 29/30* (2006.01)
*F04D 29/42* (2006.01)
*F04D 29/28* (2006.01)

(52) U.S. Cl.
CPC ..... *F04D 29/4226* (2013.01); *F04D 29/281* (2013.01)

(58) Field of Classification Search
CPC ..... F04D 29/281; F04D 29/30; F04D 29/4226
See application file for complete search history.

(56) References Cited

U.S. PATENT DOCUMENTS 3,225,422 A * 12/1965 Sebok ..... B21D 53/267 29/889.4
4,859,140 A * 8/1989 Passadore ..... F04D 29/464 415/48

(Continued)

FOREIGN PATENT DOCUMENTS

CN 1522343 A 8/2004
CN 203394851 U 1/2014

(Continued)

*Primary Examiner* — Ninh H. Nguyen
(74) *Attorney, Agent, or Firm* — Matthias Scholl P.C.; Matthias Scholl

(57) ABSTRACT

A centrifugal impeller including a wheel cover, a wheel disc, and a plurality of blades disposed between the wheel cover and the wheel disc. The wheel cover and the wheel disc each includes a sheet metal, and the plurality of blades includes a composite material. The wheel cover includes an air inlet. The wheel disc includes a central part and a motor mounting base disposed on the central part. Every two adjacent blades form an air channel including an air outlet. The plurality of blades each includes a metal frame, and a plastic shell disposed on the metal frame. Two ends of the metal frame are connected to the wheel cover and the wheel disc, respectively. The metal frame is integrated with the plastic shell through injection molding. The plastic shell is wrapped around at least a part of the metal frame.

10 Claims, 20 Drawing Sheets

(56) References Cited

U.S. PATENT DOCUMENTS

| | | | | |
|---|---|---|---|---|
| 5,558,499 | A * | 9/1996 | Kobayashi | F04D 29/023 416/186 R |
| 5,755,555 | A * | 5/1998 | Swift | F04D 29/281 415/206 |
| 9,109,605 | B2 * | 8/2015 | Chou | F04D 29/282 |
| 2005/0106024 | A1 | 5/2005 | Vasilescu et al. | |

FOREIGN PATENT DOCUMENTS

| | | | |
|---|---|---|---|
| CN | 104797825 | A | 7/2015 |
| CN | 106917764 | A | 7/2017 |
| CN | 206352592 | U | 7/2017 |
| CN | 109595200 | A | 4/2019 |
| JP | 3177191 | U | 7/2012 |

* cited by examiner

CENTRIFUGAL IMPELLER AND CENTRIFUGAL FAN COMPRISING THE SAME

CROSS-REFERENCE TO RELATED APPLICATIONS

This application is a continuation-in-part of International Patent Application No. PCT/CN2019/104617 with an international filing date of Sep. 6, 2019, designating the United States, now pending, and further claims foreign priority benefits to Chinese Patent Application No. 201910028924.5 filed Jan. 12, 2019 and Chinese Patent Application No. 201920048794.7 filed Jan. 12, 2019. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to a centrifugal impeller and a centrifugal fan comprising the same.

Conventionally, a centrifugal impeller comprises a wheel disc, a wheel cover, and a plurality of blades. There are two types of conventional centrifugal impellers: a peripheral flow impeller (P-type impeller) manufactured by an injection molding process; and a mixed flow impeller (M-type impeller) manufactured by stamping, riveting and welding sheet metals. Referring to FIGS. 1 and 2, the M-type centrifugal impeller comprises a wheel cover A1, a wheel disc A2, and a plurality of blades A3 disposed between the wheel cover A1 and the wheel disc A2. An air inlet is provided at the center of the wheel cover A1, and a motor mounting base is configured at the center of the wheel disc A2. An air channel A31 is formed between every two adjacent blades A3. A plurality of locating blocks A32 is disposed on two end faces of the blades A3. The wheel cover A1 comprises a plurality of first mounting holes A12 corresponding to the locating blocks A32. The wheel disc A2 comprises a plurality of second mounting holes A22 corresponding to the locating blocks A32. The plurality of locating blocks A32 is welded in the corresponding plurality of first mounting holes A12 and the plurality of second mounting holes A22 thereby installing the plurality of blades A3 on the wheel cover A1 and the wheel disc A2. The plurality of blades has equal thickness. From aerodynamics point of view, the M-type impeller is not compatible with complex gas flow.

The injection molding process of the P-type centrifugal impeller is subject to a plurality of uncontrollable factors including demolding, ejection, contraction of blades, bubbles, etc. And, the P-type centrifugal impeller produced conventionally comprises plastic material, which is easy to age and deform.

SUMMARY

The disclosure provides a centrifugal impeller comprising a wheel cover, a wheel disc, and a plurality of blades disposed between the wheel cover and the wheel disc. The wheel cover and the wheel disc each comprises a sheet metal, and the plurality of blades comprises a composite material. The wheel cover comprises an air inlet. The wheel disc comprises a central part and a motor mounting base disposed on the central part. Every two adjacent blades form an air channel comprising an air outlet. The plurality of blades each comprises a metal frame, and a plastic shell disposed on the metal frame. Two ends of the metal frame are connected to the wheel cover and the wheel disc, respectively. The thickness of the plastic shell is variable. The metal frame is integrated with the plastic shell through injection molding. The plastic shell is wrapped around at least a part of the metal frame.

The relationship between a maximum thickness $H_{max}$ of the plastic shell and the thickness Ho of the metal frame is as follows: $Ho \le H_{max} \le 8\ Ho$.

The metal frame comprises a main body comprising a first end face and a second end face, and a plurality of locating blocks protruding from the first end face and the second end face, respectively. The wheel cover comprises a plurality of first mounting holes, and the wheel disc comprises a plurality of second mounting holes. The plurality of locating blocks on the first end face and the second end face are disposed in the plurality of first mounting holes and the plurality of second mounting holes, respectively, whereby the wheel cover, the wheel disc, and the metal frame are fixedly connected to each other by welding or riveting.

The metal frame is formed by stamping a plurality of sheet metals having equal thickness. The metal frame comprises a central camber line A. The cross section of the plastic shell comprises a first curve and a second curve. The first curve and the second curve are symmetrical or asymmetrical with respect to the central camber line A.

The plastic shell comprises a first part close to the air inlet, a second part, and a third part close to the air outlet; the second part is disposed between the first part and the third part; the thickness of the plastic shell increases from the first part to the second part, and then decreases from the second part to the third part.

The plastic shell is wrapped around a part of the main body of the metal frame close to the air inlet, and rest of the main body is uncovered.

Optionally, the plastic shell is wrapped around the entire main body of the metal frame.

The thickness of the plastic shell decreases along a direction from the air inlet to the air channel.

The main body comprises a plurality of through holes, a plurality of ribs, or a plurality of protrusions. The plastic shell is wrapped around the plurality of through holes, ribs, or protrusions.

The central camber line A is a circular arc with a chord line L, and the following equation is satisfied:

$$y = \left[\left(\frac{0.5}{\frac{\sin\theta}{2}}\right)^2 - (x-0.5)^2\right]^{\frac{1}{2}} - \frac{0.5}{\frac{\tan\theta}{2}};$$

where θ refers to a bending angle of the central camber line A, and x and y refer to a coordinate value of a point on the central camber line A.

The central camber line A comprises a plurality of circular arcs, with a chord line L. $O_1$ and $O_2$ refers to the centers of the two circular arcs in FIG. 17, respectively, and $R_1$ and $R_2$ refer to the radiuses of the two circular arcs, respectively. The central camber line A satisfies the following equation:

$$x \le 0.45\text{时}, y = \left[\left(\frac{0.45}{\sin(0.6\theta)}\right)^2 - (x-0.45)^2\right]^{\frac{1}{2}} - \frac{0.45}{\tan(0.6\theta)};$$

-continued $$x > 0.45, \; y = \left[\left(\frac{0.55}{\sin(0.4\theta)}\right)^2 - (x-0.45)^2\right]^{\frac{1}{2}} - \frac{0.55}{\tan(0.4\theta)};$$

where θ refers to a bending angle of the central camber line A, and x and y refer to a coordinate value of a point on the central camber line A.

The central camber line A is a parabola with a chord line L, and the following equation is satisfied:

$$\frac{1}{y} = \frac{\cot(0.6\theta)}{x} - \frac{\cot(0.4\theta)}{1-x},$$

where θ refers to a bending angle of the central camber line A, and x and y refer to a coordinate value of a point on the central camber line A.

The coordinate value of a point on the first curve and the second curve are determined as follows:

the first curve:

$$\begin{cases} x_u = x - y_{ex}\sin\varphi_x \\ y_u = y + y_{ex}\cos\varphi_x \end{cases};$$

the second curve:

$$\begin{cases} x_1 = x + y_{ex}\sin\varphi_x \\ y_1 = y - y_{ex}\cos\varphi_x \end{cases};$$

where $$\varphi = \tan^{-1}\frac{dy}{dx};$$

where $\varphi_x$ is an included angle between a tangent at a point on the central camber line A and an x-axis;

x and y refer to a coordinate value of a point on the central camber line A;

$x_u$ and $y_u$ refer to a coordinate value of a point on the first curve; and $x_1$ and $y_1$ refer to a coordinate value of a point on the second curve.

A method for manufacturing the centrifugal impeller of the disclosure comprises selecting a conventional centrifugal impeller, replacing an original plastic shell of the conventional centrifugal impeller with the plastic shell of the disclosure, and the original shapes of the wheel cover, the wheel disc and the metal frame of conventional centrifugal impeller are unchanged.

Also provided is a centrifugal fan, comprising: a centrifugal impeller of the disclosure, a motor and a volute. The volute comprises a cavity, an air inlet and an air channel. The centrifugal impeller is disposed in the cavity, and the air inlet and the air channel communicate with the cavity; the centrifugal impeller is disposed on the motor and driven by the motor.

The following advantages are associated with the centrifugal impeller and the centrifugal fan comprising the same of the disclosure.

1) The centrifugal impeller comprises a metal wheel cover, a metal wheel disc, and a plurality of blades comprising composite material. The plurality of blades is disposed between the wheel cover and the wheel disc. The plurality of blades each comprises a metal frame, and a plastic shell disposed on the metal frame. Two ends of the metal frame are connected to the wheel cover and the wheel disc, respectively. The metal frame is integrated with the plastic shell through injection molding, and the plastic shell is wrapped around at least a part of the metal frame, thereby increasing the structural strength of the centrifugal impeller, meeting the aerodynamic performance requirements, and ensuring the reliability of the entire structure.

2) The method for manufacturing the centrifugal impeller of the disclosure, shortens the development cycle of the centrifugal impeller, and reduces the cost of development, manufacturing and labor.

3) The metal frame is formed by stamping a plurality of sheet metals having equal thickness, and is recyclable, which is environmentally friendly.

4) The plastic shell comprises a first part close to the air inlet, a second part, and a third part close to the air outlet. The second part is disposed between the first part and the third part. The thickness of the plastic shell increases from the first part to the second part, and then decreases from the second part to the third part, thereby improving the aerodynamic performance, and reducing the cost.

5) The plastic shell is wrapped around a part of the main body of the metal frame close to the air inlet, and rest of the main body is uncovered, which is easy to manufacture.

6) Optionally, the plastic shell is wrapped around the entire main body of the metal frame, improving the aerodynamic performance of the centrifugal impeller.

7) The thickness of the plastic shell decreases along the direction from the air inlet to the air outlet, thereby improving the aerodynamic performance of the centrifugal impeller.

8) The main body comprises a plurality of through holes, a plurality of ribs, or a plurality of protrusions. The plastic shell is wrapped around the plurality of through holes, ribs, or protrusions, thereby increasing the bonding force between the metal frame and the plastic shell, and improving the structural strength.

DETAILED DESCRIPTION

Figure 1:
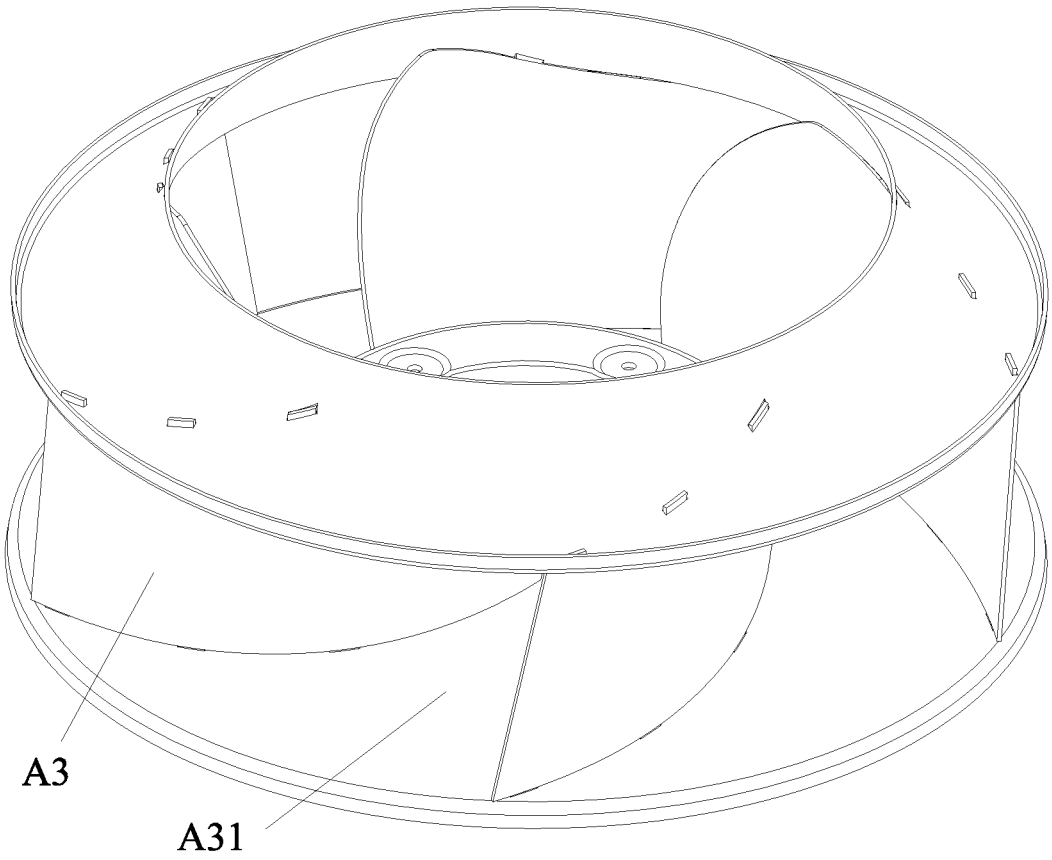
FIG. 1 (Prior art)
FIG. 1 is a perspective view of a centrifugal impeller in the related art.
Figure 2:
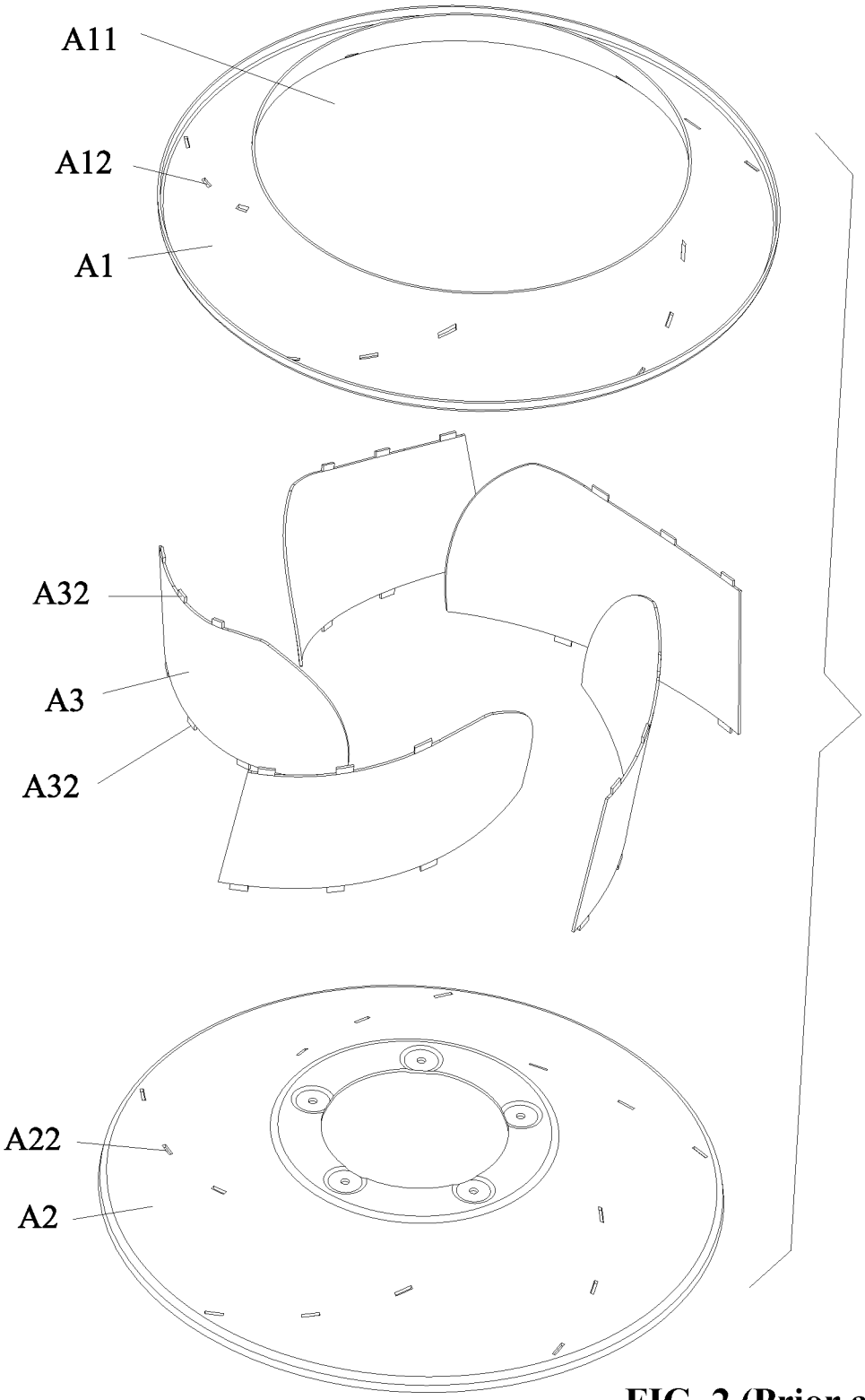
FIG. 2 (Prior art)
FIG. 2 is an exploded view of a centrifugal impeller in the related art.
Figure 3:
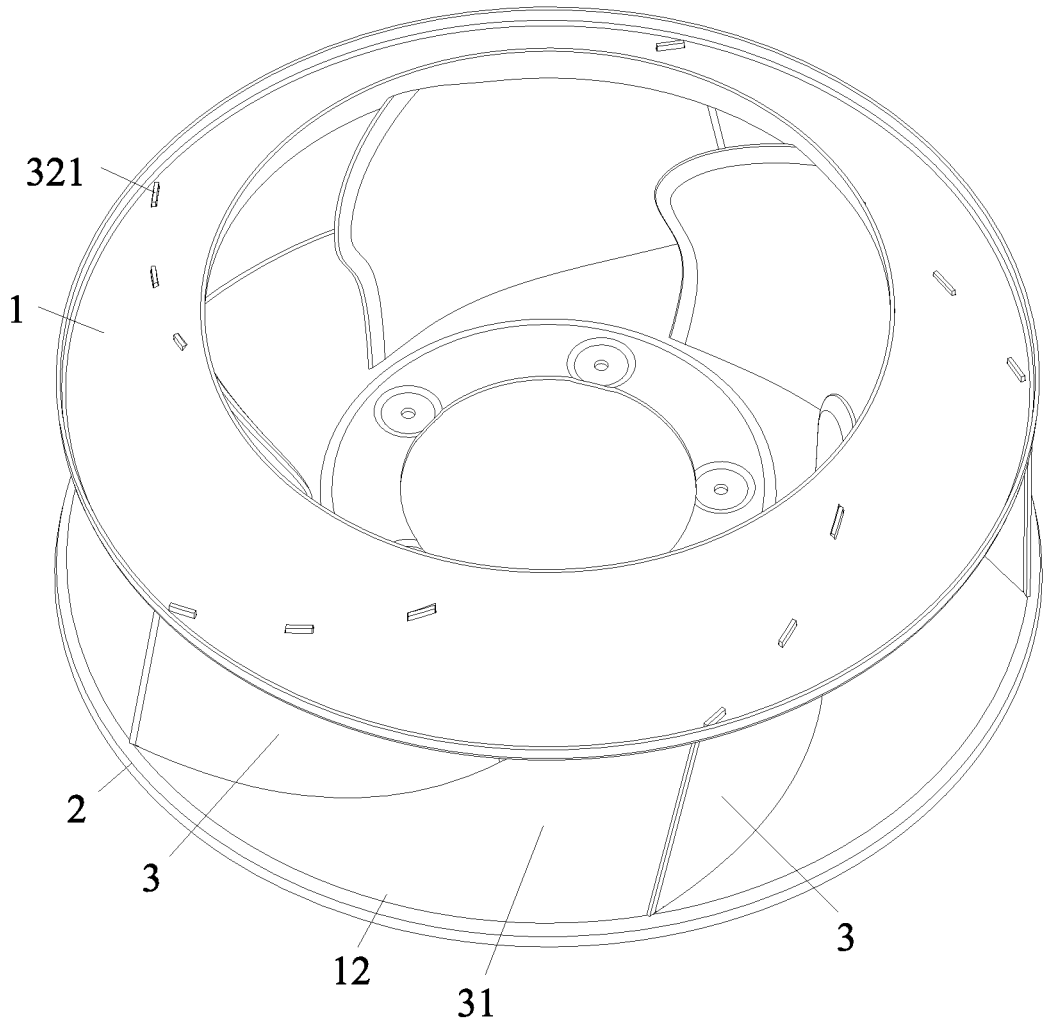
FIG. 3 is a schematic diagram of a centrifugal impeller comprising a main body completely covered by a plastic shell in accordance with Example 1 of the disclosure.
Figure 4:
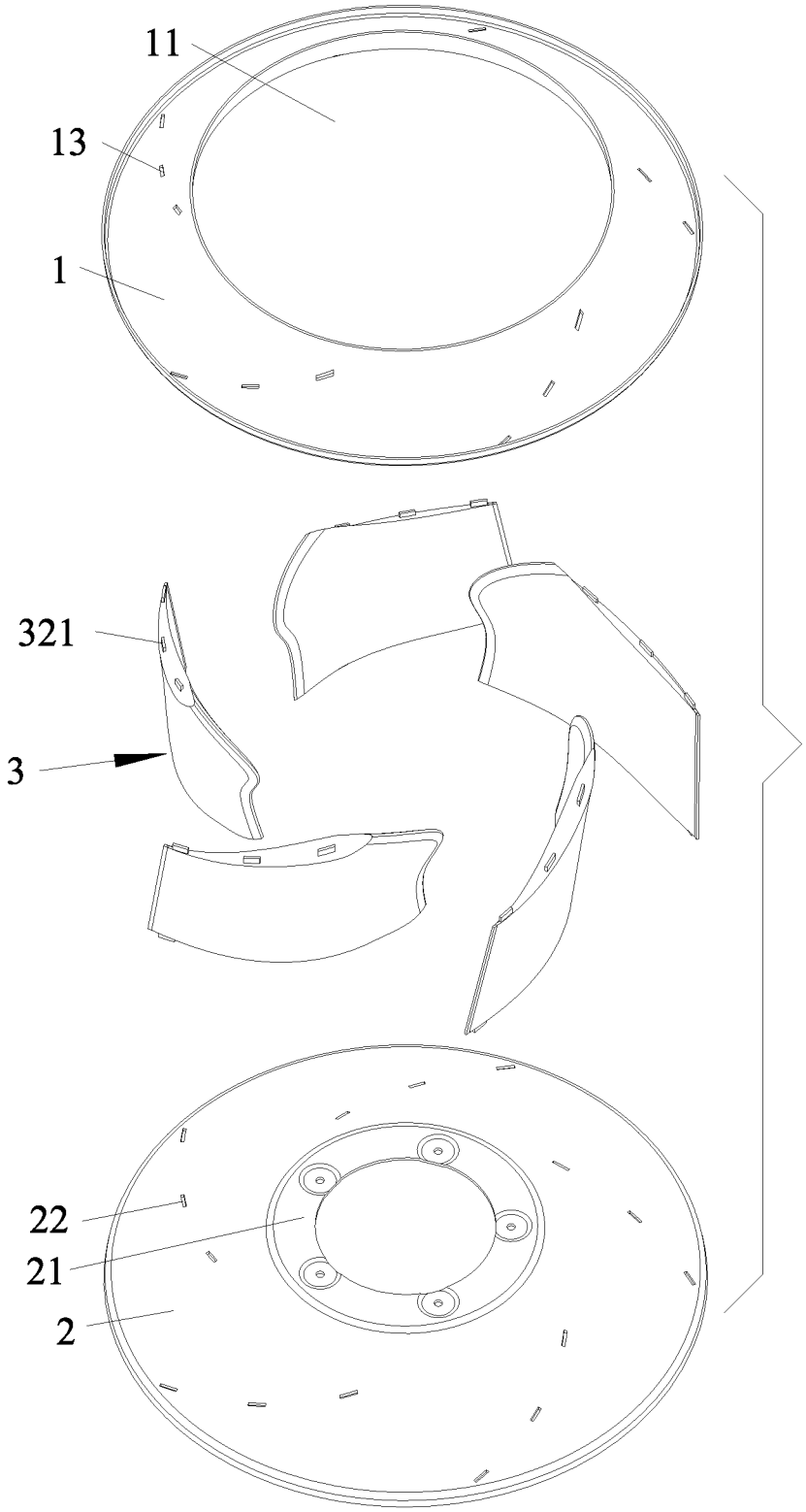
FIG. 4 is an exploded view of a centrifugal impeller comprising a main body completely covered by a plastic shell in accordance with Example 1 of the disclosure.
Figure 5:
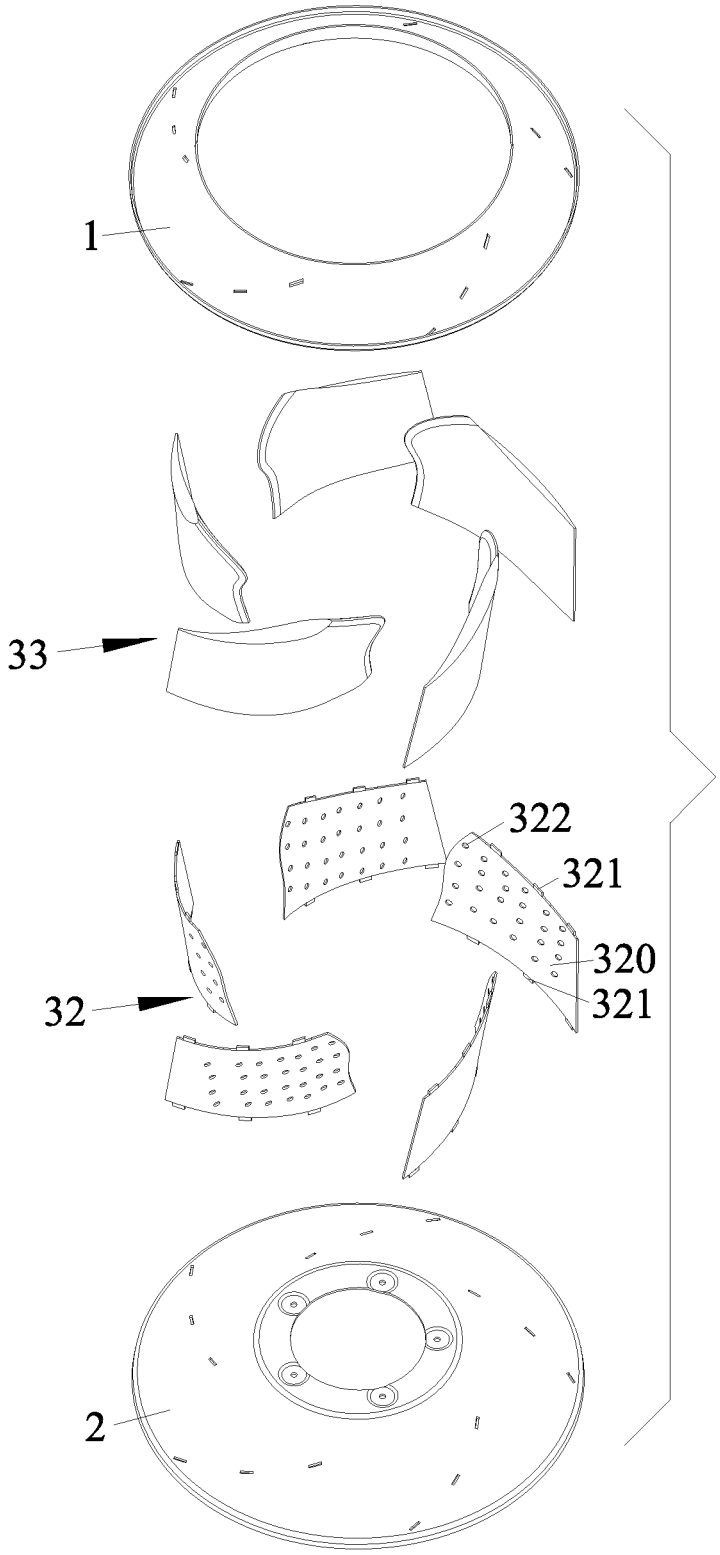
FIG. 5 is another exploded view of a centrifugal impeller comprising a main body completely covered by a plastic shell in accordance with Example 1 of the disclosure.
Figure 6:
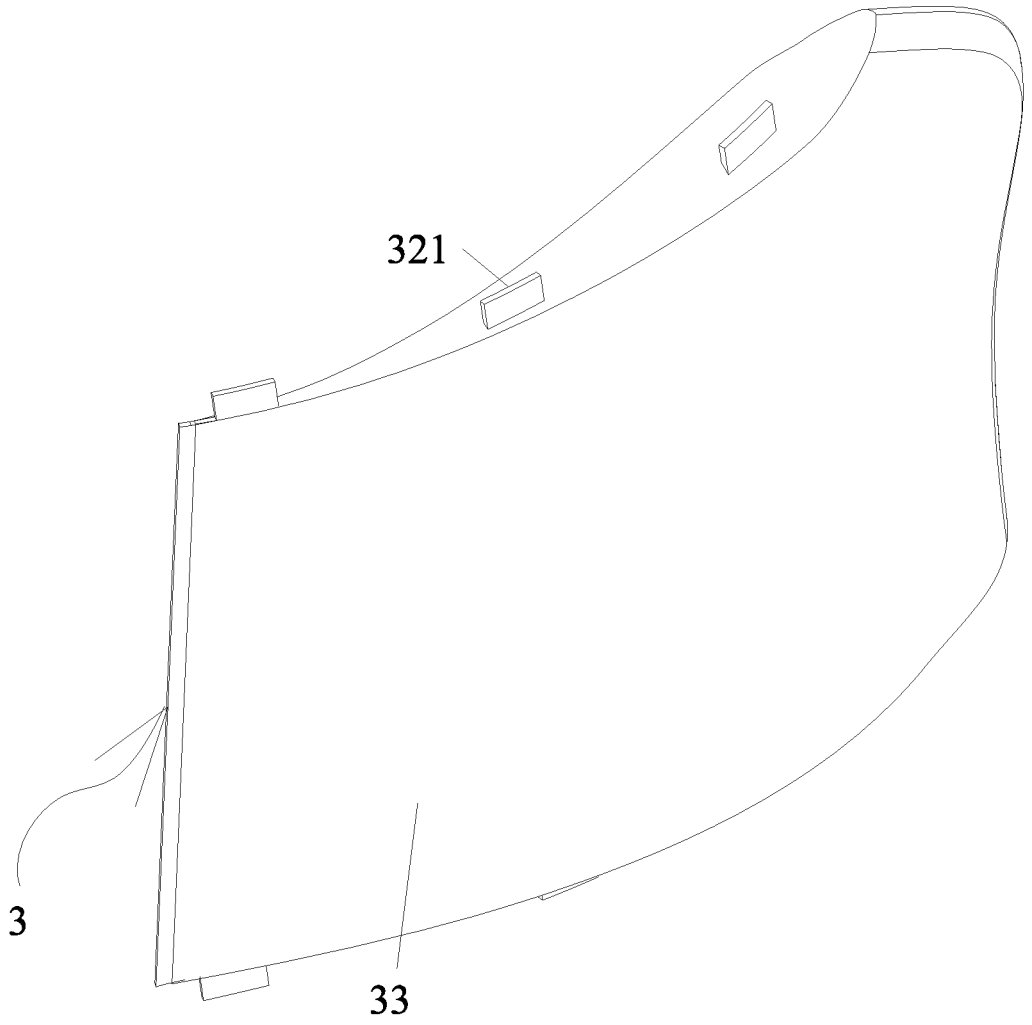
FIG. 6 is a schematic diagram of a blade in accordance with Example 1 of the disclosure.
Figure 7:
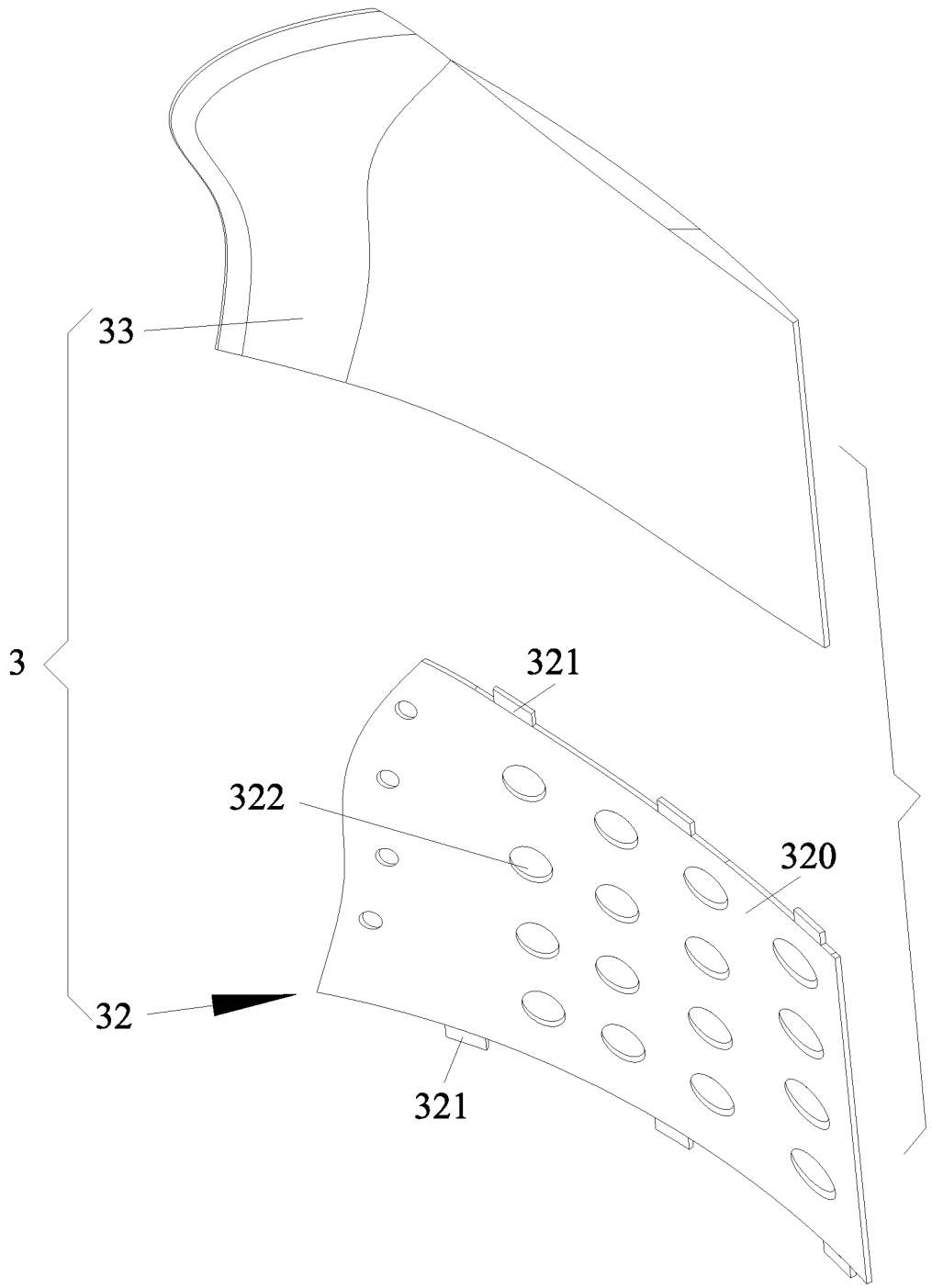
FIG. 7 is an exploded view of a blade in accordance with Example 1 of the disclosure.
Figure 8:
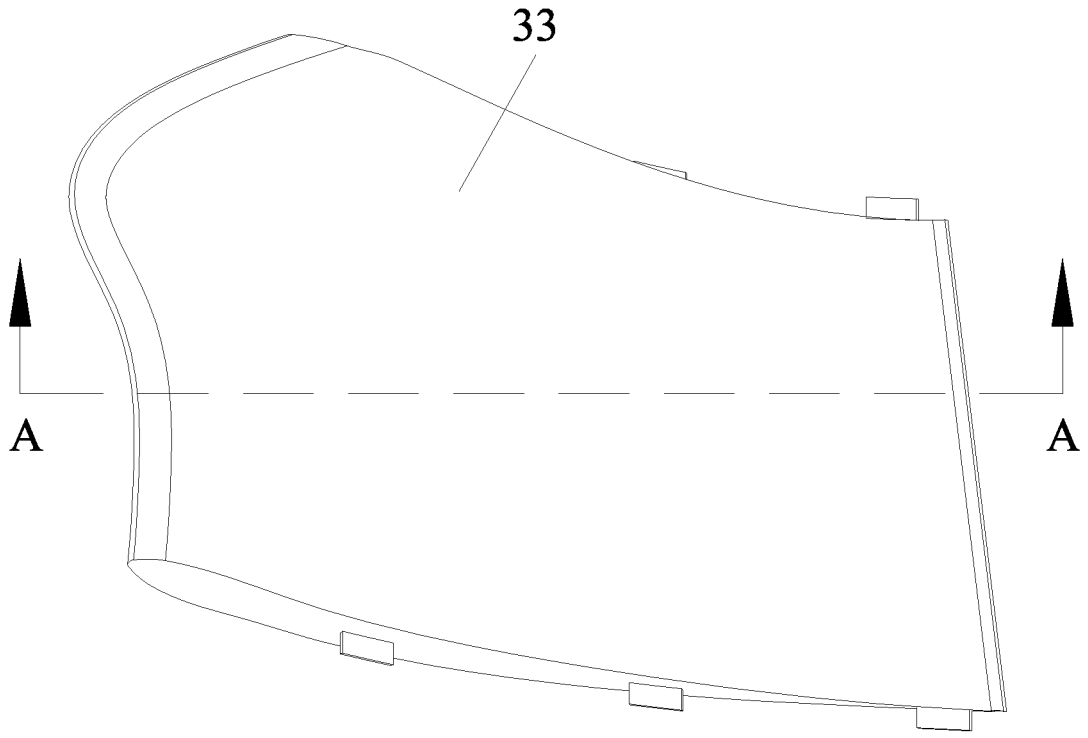
FIG. 8 is a front view of each of a blade in accordance with Example 1 of the disclosure.
Figure 9:
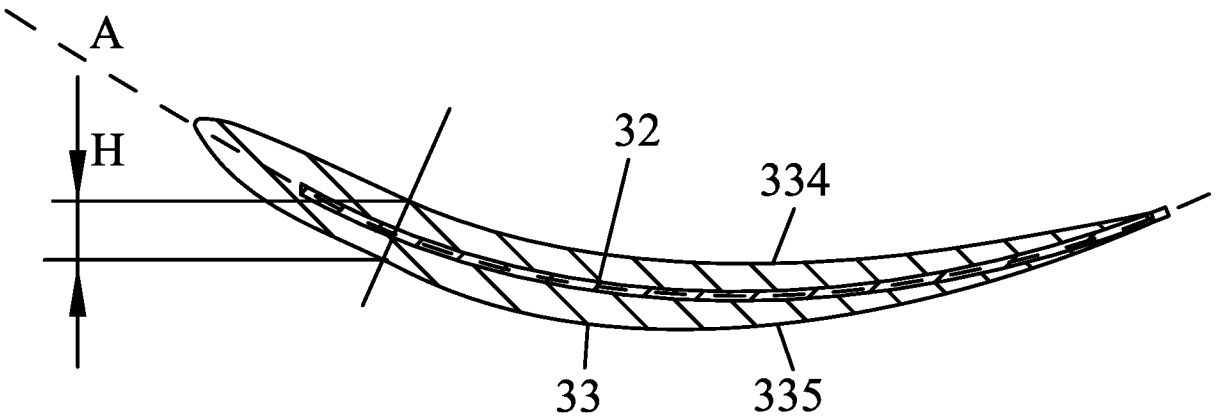
FIG. 9 is a cross-sectional view taken along line A-A in FIG. 8.
Figure 10:
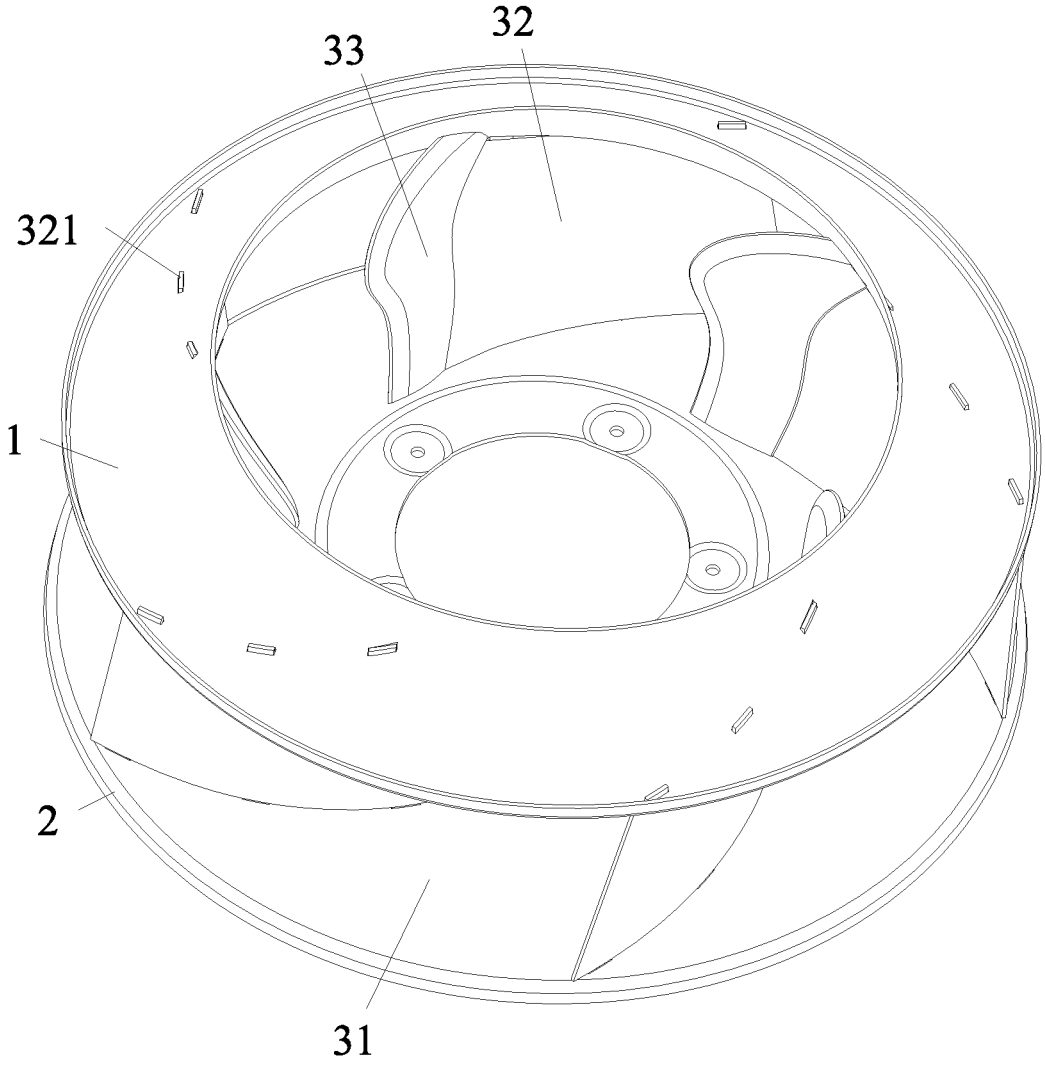
FIG. 10 is a schematic diagram of a centrifugal impeller comprising a main body partly covered by a plastic shell in accordance with Example 2 of the disclosure.
Figure 11:
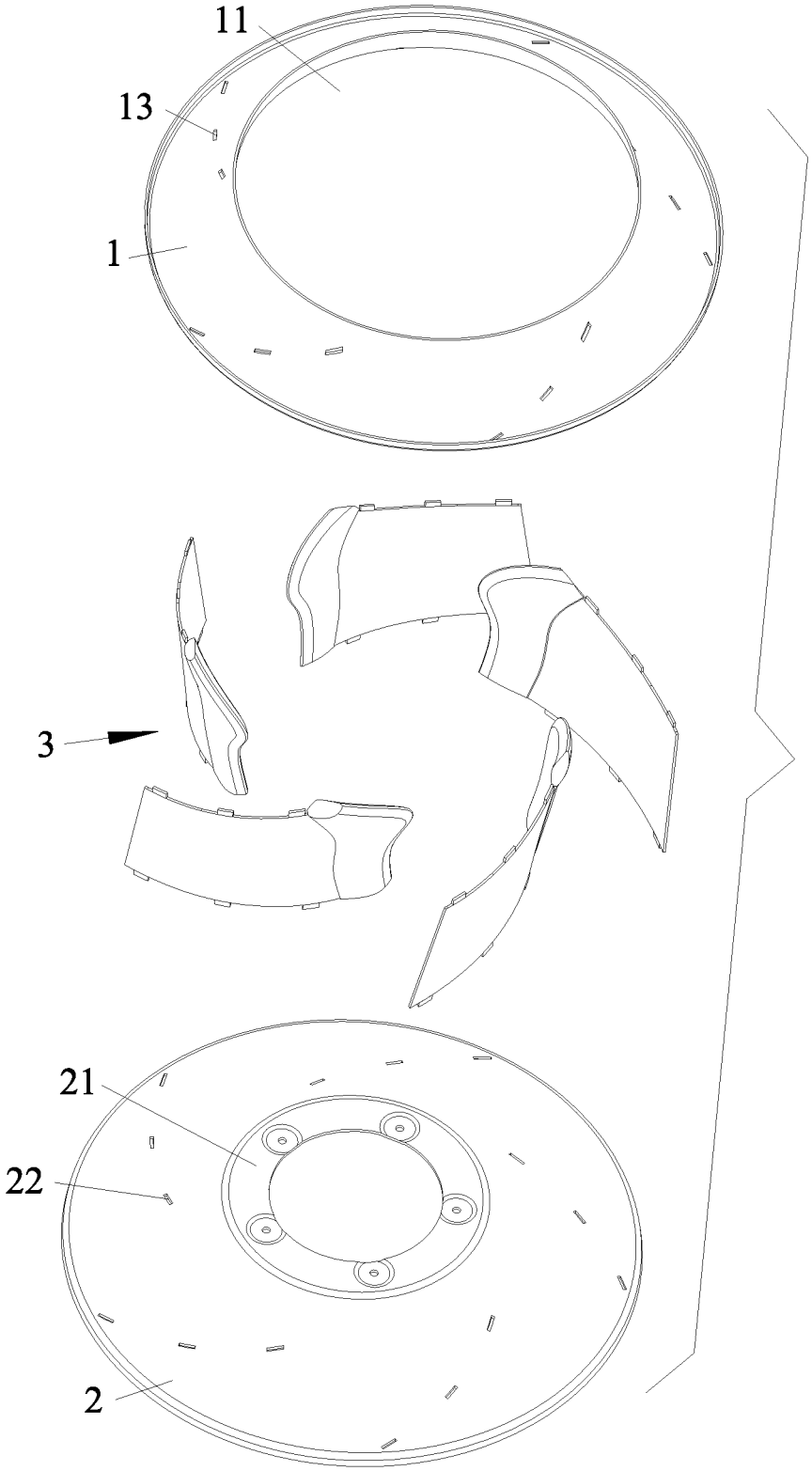
FIG. 11 is an exploded view of a centrifugal impeller comprising a main body partly covered by a plastic shell in accordance with Example 2 of the disclosure.
Figure 12:
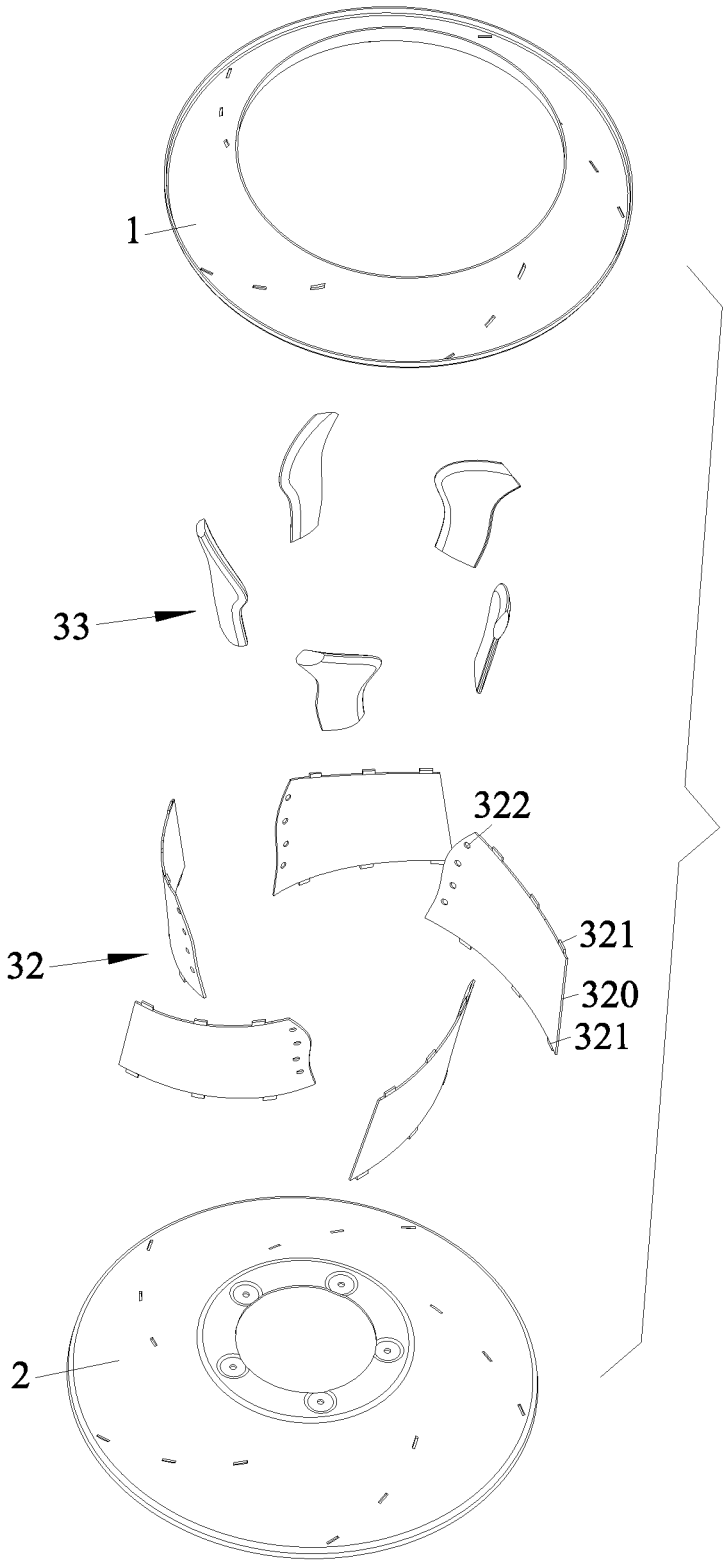
FIG. 12 is another exploded view of a centrifugal impeller comprising a main body partly covered by a plastic shell in accordance with Example 2 of the disclosure.
Figure 13:
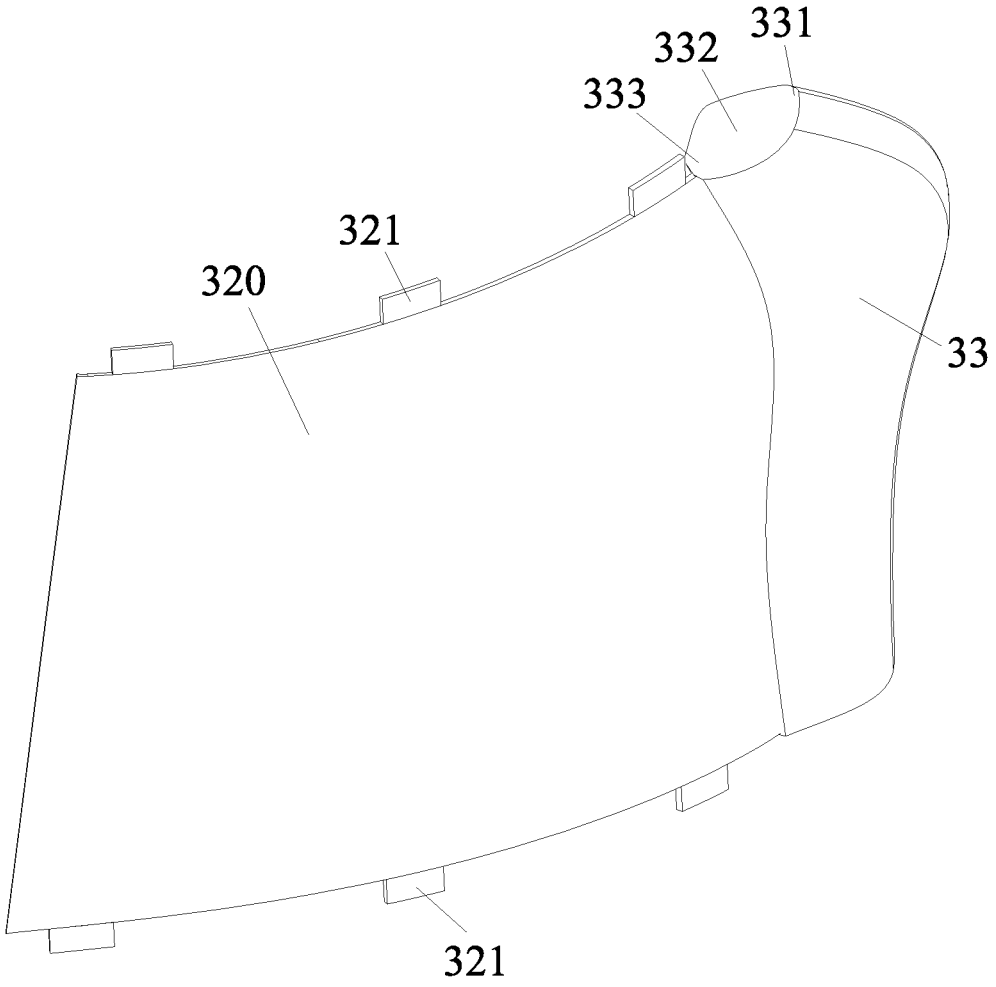
FIG. 13 is a schematic diagram of a blade in accordance with Example 2 of the disclosure.
Figure 14:
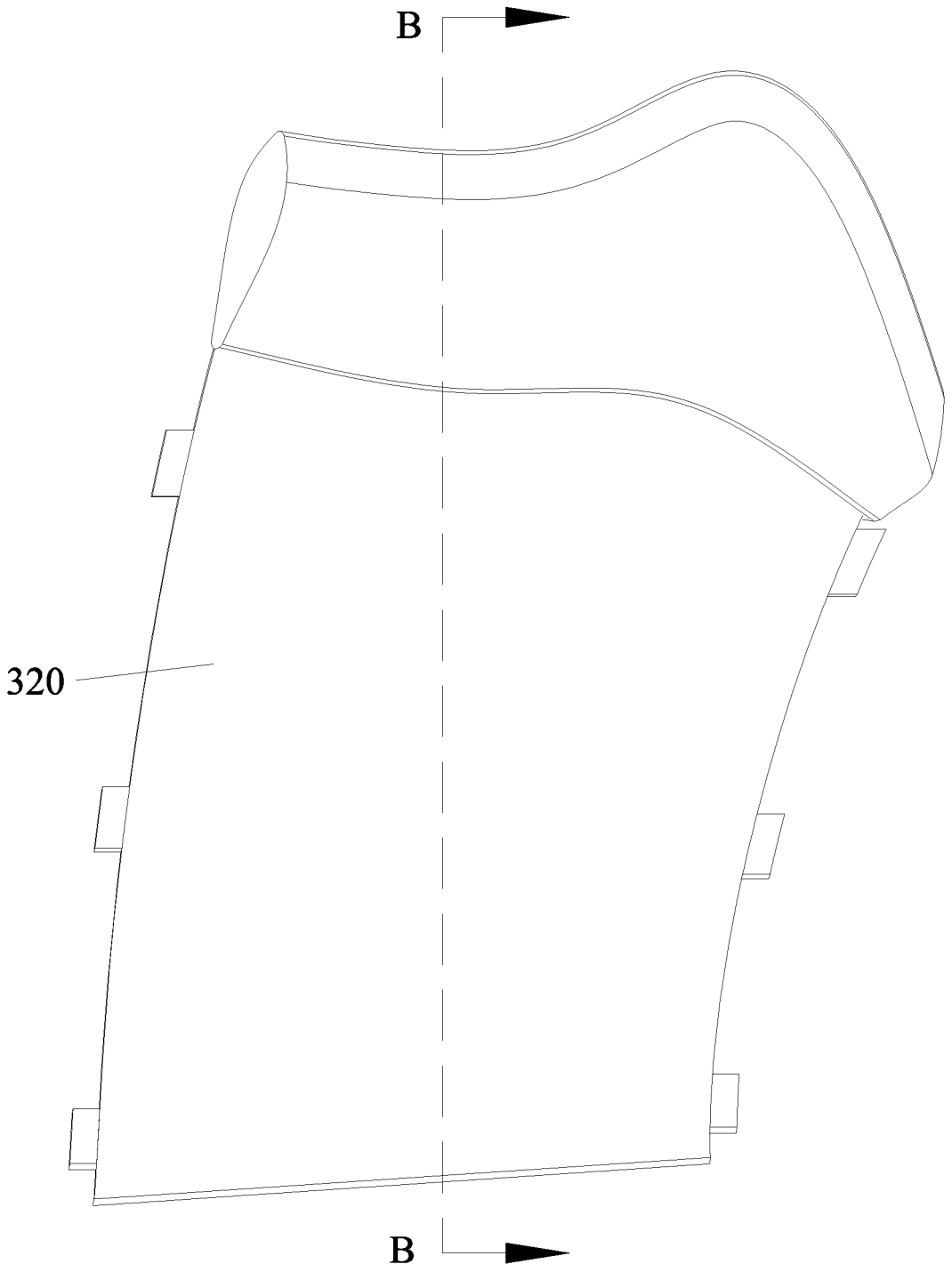
FIG. 14 is a front view of a blade in accordance with Example 2 of the disclosure.
Figure 15:
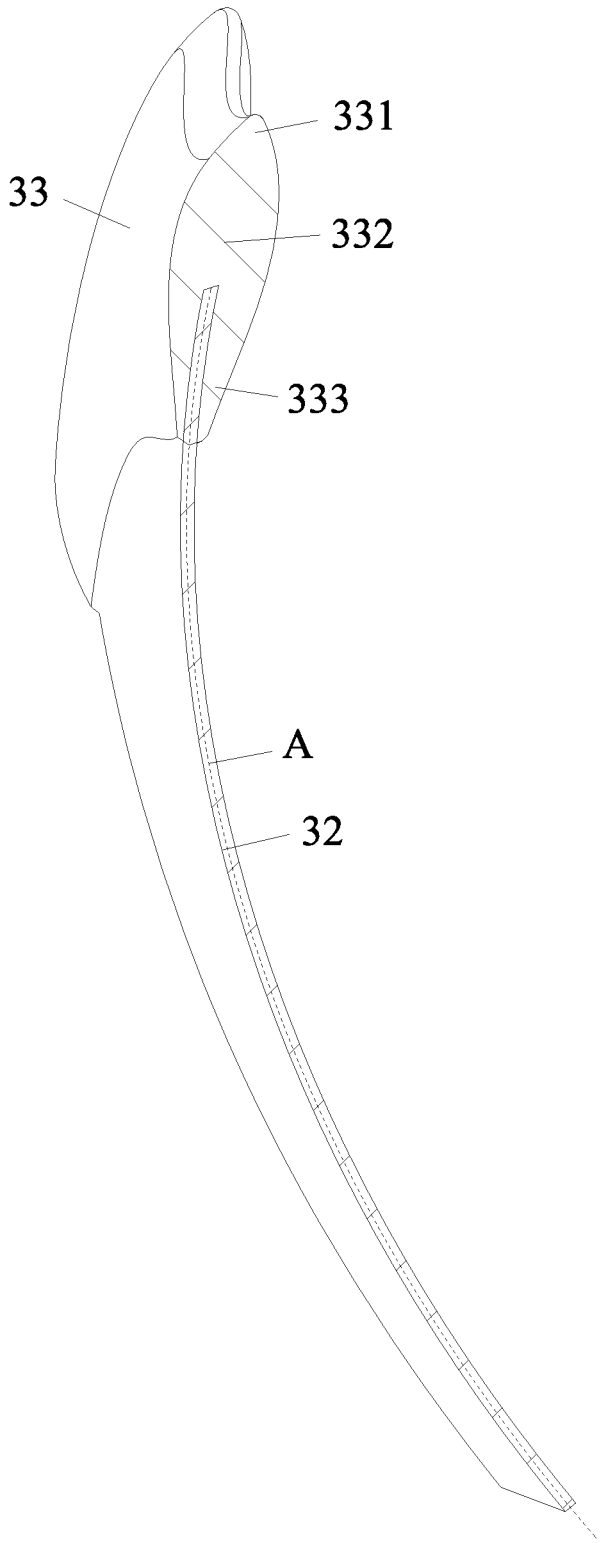
FIG. 15 is a sectional view taken along line B-B in FIG. 14.

To further illustrate the invention, embodiments detailing a centrifugal impeller and a centrifugal fan comprising the same are described below. It should be noted that the following embodiments are intended to describe and not to limit the disclosure

Example 1

Referring to FIGS. 3-9, provided is a centrifugal impeller, comprising a wheel cover 1, a wheel disc 2, and a plurality of blades 3 disposed between the wheel cover 1 and the wheel disc 2. The wheel cover 1 and the wheel disc 2 each comprises a sheet metal, and the plurality of blades 3 comprises a composite material. The wheel cover 1 comprises an air inlet 11. The wheel disc 2 comprises a central part and a motor mounting base 21 disposed on the central part. Every two adjacent blades 3 form an air channel 31 comprising an air outlet 12. The plurality of blades 3 each comprises a metal frame 32, and a plastic shell 33 disposed on the metal frame 32. Two ends of the metal frame 32 are connected to the wheel cover 1 and the wheel disc 2, respectively. The thickness of the plastic shell 33 is variable. The metal frame 32 is integrated with the plastic shell 33 through injection molding. The plastic shell 33 is wrapped around at least a part of the metal frame 32.

Figure 19:
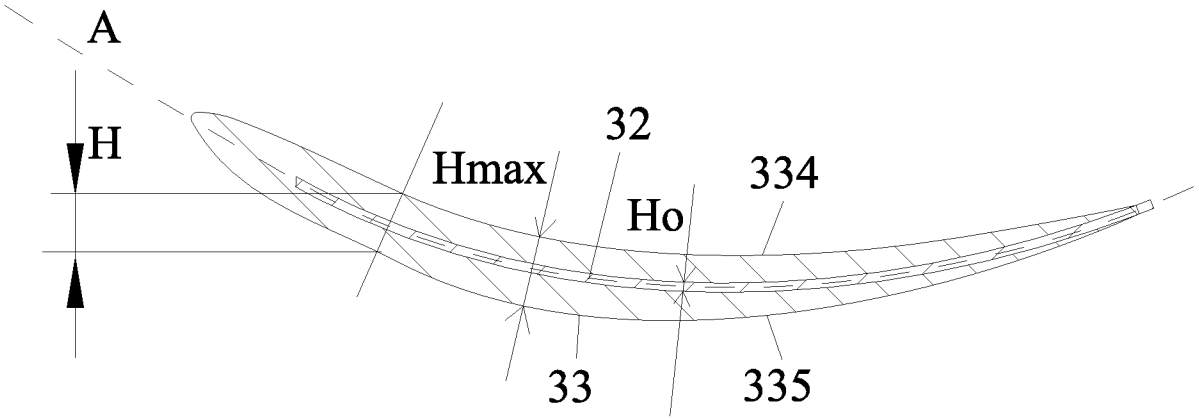
FIG. 19 is a cross-sectional view of a blade in the disclosure.

Referring to FIG. 19, $H_{max}$ refers to the maximum thickness of the plastic shell 33, and Ho refers to the thickness of the metal frame 32. The relationship between the maximum thickness $H_{max}$ and the thickness Ho is as follows: $Ho \leq H_{max} \leq 8$ Ho, thus determining an outer contour line of the plastic shell 33 that maintains sufficient structural strength while optimizing the aerodynamic performance of the centrifugal impeller.

The metal frame 32 comprises a main body 320 comprising a first end face and a second end face, and a plurality of locating blocks 321 protruding from the first end face and the second end face, respectively. The wheel cover 1 comprises a plurality of first mounting holes 12, and the wheel disc 2 comprises a plurality of second mounting holes 22. The plurality of locating blocks 321 on the first end face and the second end face are disposed in the plurality of first mounting holes 12 and the plurality of second mounting holes 22, respectively, whereby the wheel cover 1, the wheel disc 2, and the metal frame 32 are fixedly connected to each other by welding or riveting.

The metal frame 32 is formed by stamping a plurality of sheet metals having equal thickness. The metal frame 32 comprises a central camber line A. The cross section of the plastic shell 33 comprises a first curve 334 and a second curve 335. The first curve 334 and the second curve 335 are symmetrical or asymmetrical with respect to the central camber line A.

The thickness of the plastic shell 33 decreases along a direction from the air inlet to the air channel.

The plastic shell 33 is wrapped around the entire main body 320 of the metal frame 32.

The thickness of the plastic shell can be variable or equal in accordance with the requirements in performance characteristics. The maximum thickness of the plastic shell 33 can be at any radius on each of the plurality of blades in the air channel.

The main body 320 comprises a plurality of through holes 322, a plurality of ribs, or a plurality of protrusions. The plastic shell 33 is wrapped around the plurality of through holes 322, ribs or protrusions, thereby increasing the bonding force between the metal frame and the plastic shell, and improving the structural strength of the centrifugal impeller.

Figure 16:
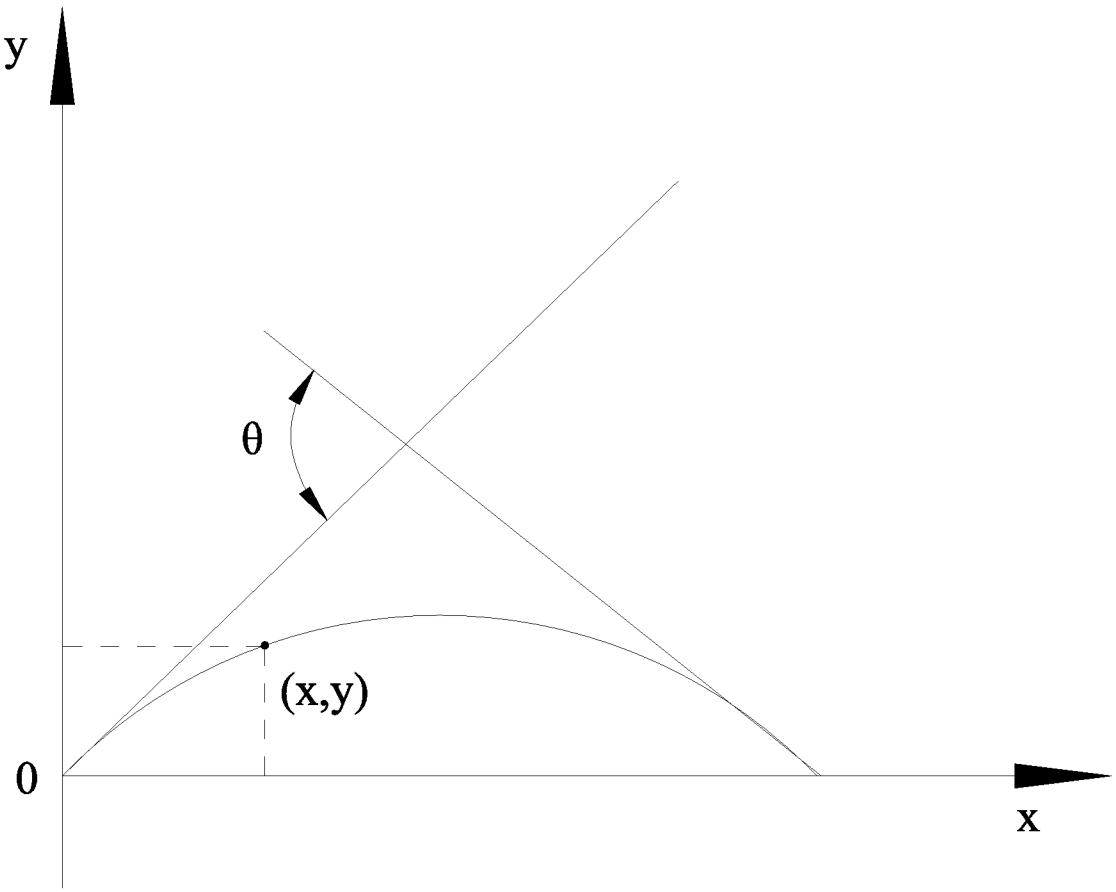
FIG. 16 is a first schematic diagram of a central camber line of a blade in the disclosure.

Referring to FIG. 16, the central camber line A is a circular arc with a chord line L, and the following equation is satisfied:

$$y = \left[\left(\frac{0.5}{\frac{\sin\theta}{2}}\right)^2 - (x-0.5)^2\right]^{\frac{1}{2}} - \frac{0.5}{\frac{\tan\theta}{2}};$$

where θ refers to a bending angle of the central camber line A, and x and y refer to a coordinate value of a point on the central camber line A.

Figure 17:
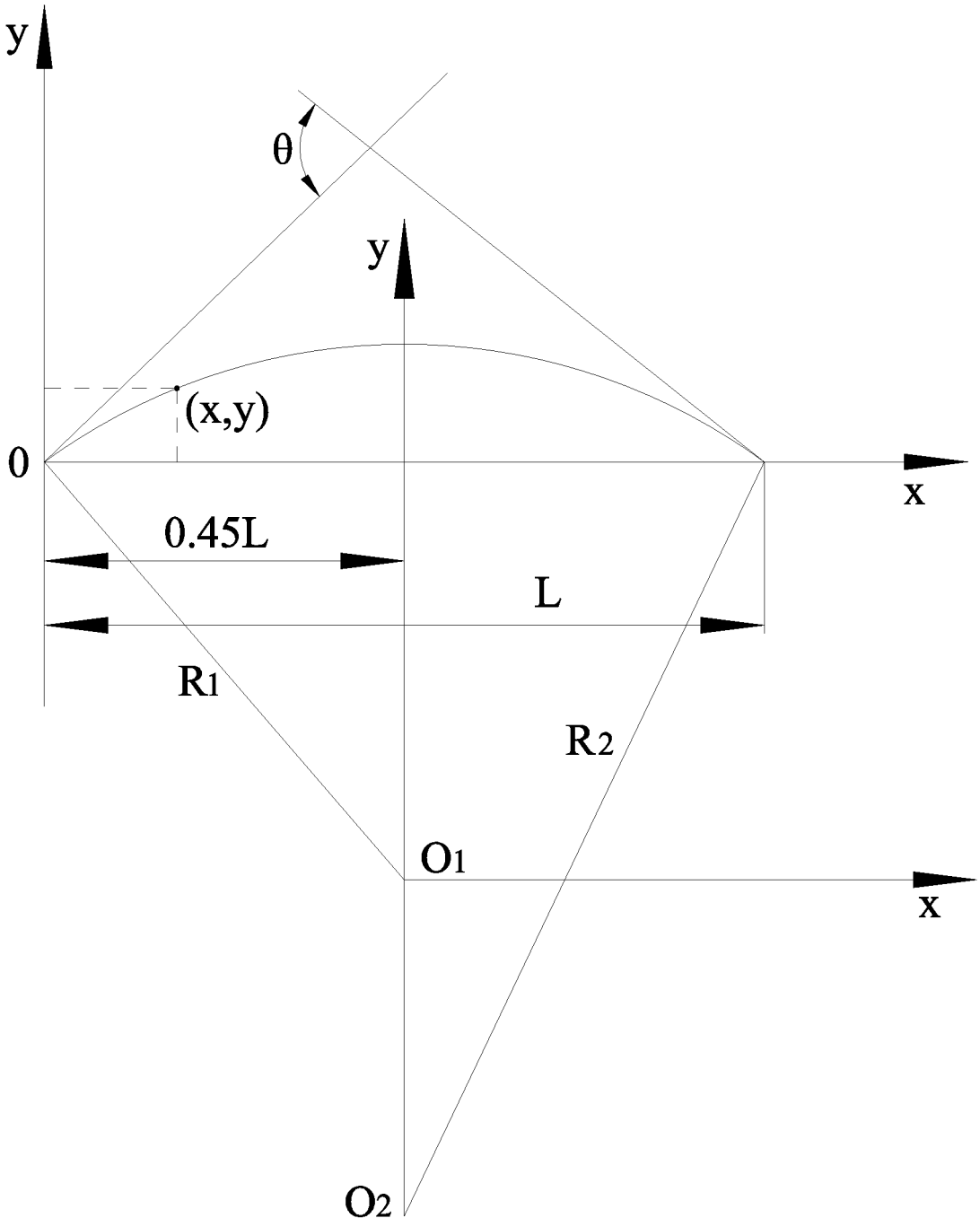
FIG. 17 is a second schematic diagram of a central camber line of a blade in the disclosure.

Referring to FIG. 17, the central camber line A comprises a plurality of circular arcs, with a chord line L. $O_1$ and $O_2$ refer to the centers of the two circular arcs in FIG. 17, respectively, and $R_1$ and $R_2$ refer to the radiuses of the two circular arcs, respectively. The central camber line A satisfies the following equation:

$$x \leq 0.45\text{寸},\ y = \left[\left(\frac{0.45}{\sin(0.6\theta)}\right)^2 - (x-0.45)^2\right]^{\frac{1}{2}} - \frac{0.45}{\tan(0.6\theta)};$$

$$x > 0.45\text{寸},\ y = \left[\left(\frac{0.55}{\sin(0.4\theta)}\right)^2 - (x-0.45)^2\right]^{\frac{1}{2}} - \frac{0.55}{\tan(0.4\theta)};$$

where θ refers to a bending angle of the central camber line A, and x and y refer to a coordinate value of a point on the central camber line A.

Figure 18:
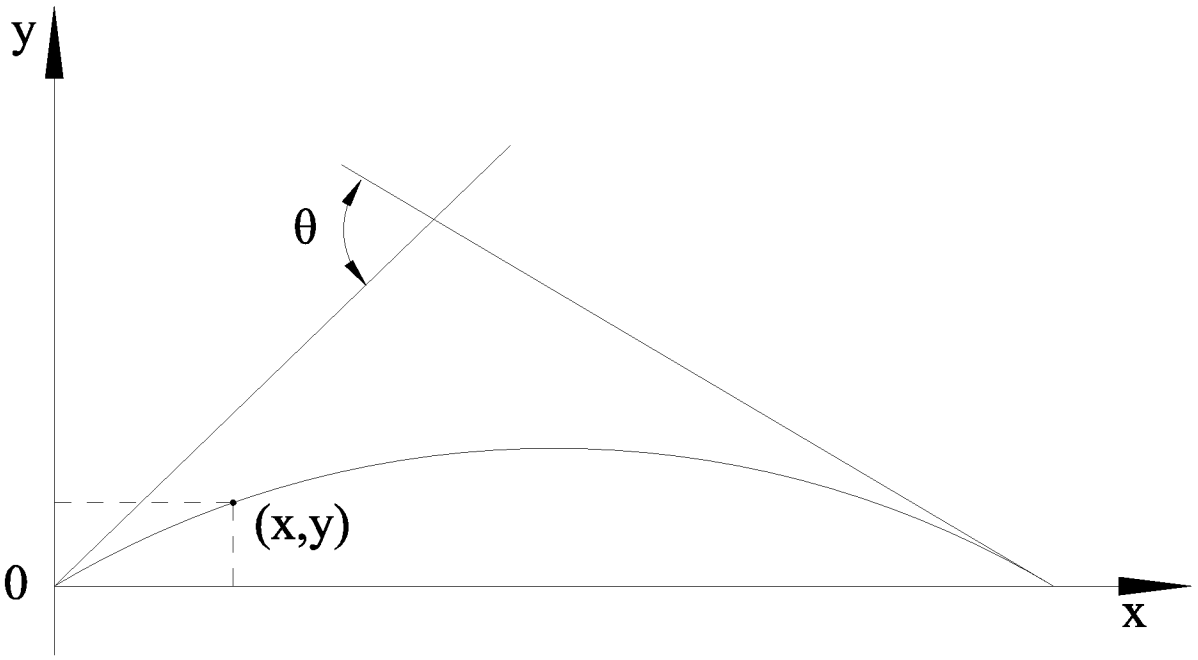
FIG. 18 is a third schematic diagram of a central camber line of a blade in the disclosure.

Referring to FIG. 18, the central camber line A is a parabola with a chord line L, and the following equation is satisfied:

$$\frac{1}{y} = \frac{\cot(0.6\theta)}{x} - \frac{\cot(0.4\theta)}{1-x},$$

where θ refers to a bending angle of the central camber line A, and x and y refer to a coordinate value of a point on the central camber line A.

Referring to FIGS. 18 and 19, the coordinate value of a point on the first curve 334 or the second curve 335 are determined as follows:

the first curve:

$$\begin{cases} x_u = x - y_{ex}\sin\varphi_x \\ y_u = y + y_{ex}\cos\varphi_x \end{cases};$$

the second curve:

$$\begin{cases} x_1 = x + y_{ex}\sin\varphi_x \\ y_1 = y - y_{ex}\cos\varphi_x \end{cases};$$

where $$\varphi = \tan^{-1}\frac{dy}{dx};$$

where $\varphi_x$ is an included angle between the tangent at any point on the central camber line A and the x-axis;

x and y refer to a coordinate value of a point on the central camber line A;

$x_u$ and $y_u$ refer to a coordinate value of a point on the first curve 334;

$x_1$ and $y_1$ refer to a coordinate value of a point on the second curve 335.

$Y_e$ refers to a vertical distance from a point on the first curve 334 or the second curve 335 to the central camber line A, which can be calculated using the following formula:

$$y_e = a_0x^{\frac{1}{2}} + a_1x + a_2x^2 + a_3x^3 + a_4x^4 + \cdots + a_nx^n;$$

where $a_0$, $a_1$, $a_2$, $a_3$, $a_4$ . . . an refer to the coefficients, and n refers to the number of times determined by the airfoil of the blade. Optionally, in other embodiment, the linear distance between the first curve 334 or the second curve 335 to the central camber line can be calculated using other mathematical models according to the actual situation.

Example 2

Referring to FIGS. 10-15, Example 2 is an improvement on the basis of Example 1. The plastic shell 33 is wrapped around a part of the main body 320 of the metal frame 32 close to the air inlet 11, and the rest of the main body 320 is uncovered.

The plastic shell 33 comprises a first part 331 close to the air inlet 11, a second part 332, and a third part 333 close to the air outlet 12. The second part is disposed between the first part and the third part. The thickness of the plastic shell increases from the first part to the second part, and then decreases from the second part to the third part. The thickness of the plastic shell can be variable or equal. The maximum thickness of the plastic shell 33 can be at any radius on each of the plurality of blades in the air channel.

Example 3

A centrifugal fan comprises a centrifugal impeller in Example 1 or 2, a motor and a volute. The volute comprises a cavity, an air inlet and an air channel. The centrifugal impeller is disposed in the cavity, and the air inlet and the air channel communicate with the cavity; the centrifugal impeller is disposed on the motor and driven by the motor.

Example 4

A method for manufacturing the centrifugal impeller of the Example 1 or 2 comprises selecting a conventional centrifugal impeller, replacing an original plastic shell of the conventional centrifugal impeller with the plastic shell of the disclosure, and the original shapes of the wheel cover, the wheel disc and the metal frame of conventional centrifugal impeller are unchanged.

Figure 20:
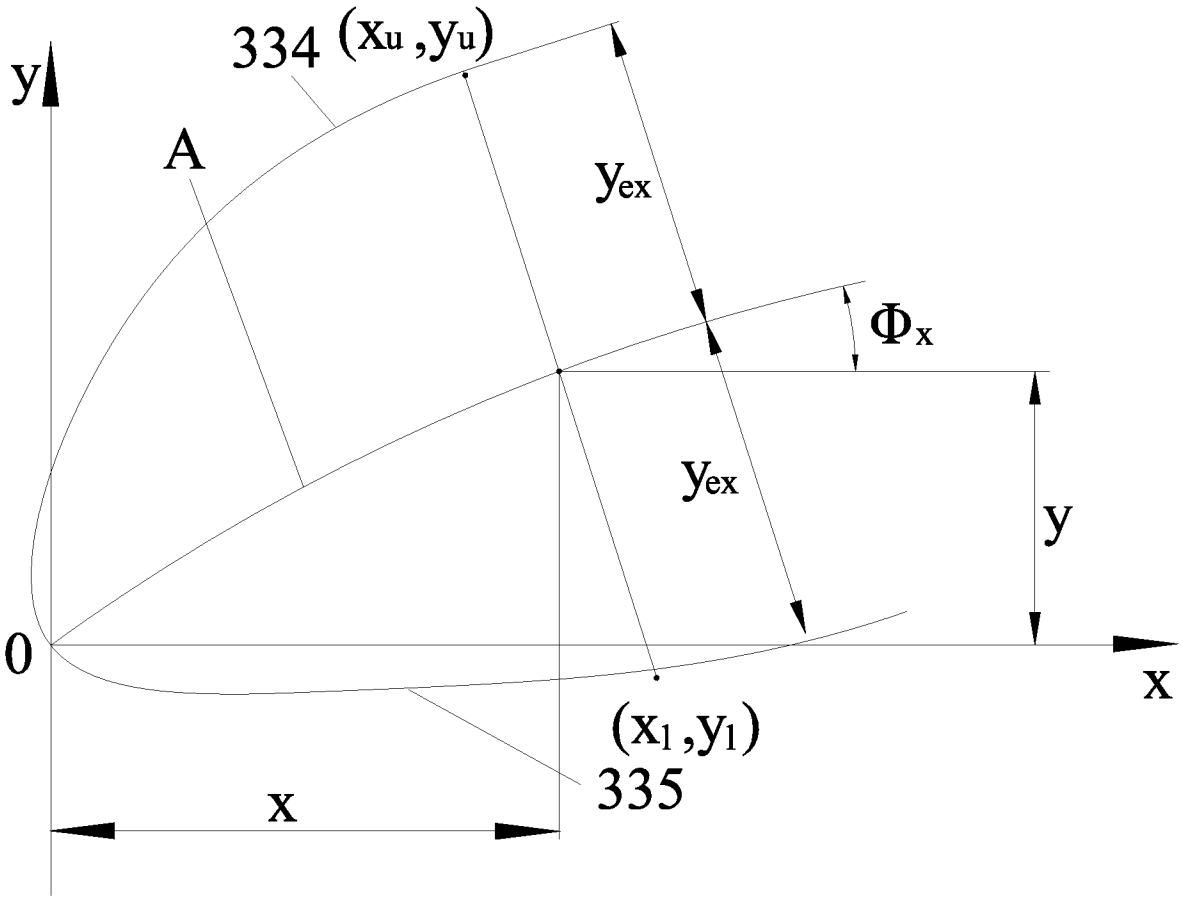
FIG. 20 is a schematic diagram of a first curve and a second curve of a blade in the disclosure.

Referring to FIGS. 19 and 20, a central camber line A of the conventional centrifugal impeller is determined, and the thickness thereof is increased by 2 mm to form the cross section of a metal frame. The metal frame is completely wrapped around a plastic shell through injection molding. The cross section of the plastic shell comprises a first curve 334 and a second curve 335.

The first curve 334 and the second curve 335 are asymmetric with respect to the central camber line A.

It will be obvious to those skilled in the art that changes and modifications may be made, and therefore, the aim in the appended claims is to cover all such changes and modifications.

What is claimed is:

1. A device, comprising:

a wheel cover comprising an air inlet;

a wheel disc; and a plurality of blades disposed between the wheel cover and the wheel disc; wherein:

the wheel cover and the wheel disc each comprise a sheet metal, and the plurality of blades comprises a composite material;

the wheel disc comprises a central part and a motor mounting base disposed on the central part;

every two adjacent blades form an air channel comprising an air outlet;

the plurality of blades each comprises a metal frame and a plastic shell disposed on the metal frame;

two ends of the metal frame are connected to the wheel cover and the wheel disc, respectively;

a thickness of the plastic shell is variable; the metal frame is integrated with the plastic shell through injection molding;

the metal frame comprises a plurality of sheet metals having equal thickness; the metal frame comprises a central camber line A; a cross section of the plastic shell comprises a first curve and a second curve; and the first curve and the second curve are symmetrical or asymmetrical with respect to the central camber line A; and the plastic shell is wrapped around a part of a main body of the metal frame close to the air inlet, and rest of the main body is uncovered.

2. The device of claim 1, wherein a relationship between a maximum thickness $H_{max}$ of the plastic shell and a thickness Ho of the metal frame is as follows: $Ho \leq H_{max} \leq 8Ho$.

3. The device of claim 1, wherein the main body of the metal fame comprises a first end face and a second end face, and the metal frame comprises a plurality of locating blocks protruding from the first end face and the second end face;

the wheel cover comprises a plurality of first mounting holes, and the wheel disc comprises a plurality of second mounting holes; the plurality of locating blocks on the first end face and the second end face are disposed in the plurality of first mounting holes and the plurality of second mounting holes, respectively, whereby the wheel cover, the wheel disc, and the metal frame are fixedly connected to each other.

4. A centrifugal fan, comprising: the device of claim 1, a motor, and a volute; wherein the volute comprises an air inlet, a cavity, and an air channel; the centrifugal impeller is disposed in the cavity, and the air inlet and the air channel communicate with the cavity; and the centrifugal impeller is disposed on the motor and driven by the motor.

5. A device, comprising:

a wheel cover comprising an air inlet;

a wheel disc; and a plurality of blades disposed between the wheel cover and the wheel disc; wherein:

the wheel cover and the wheel disc each comprise a sheet metal, and the plurality of blades comprises a composite material;

the wheel disc comprises a central part and a motor mounting base disposed on the central part;

every two adjacent blades form an air channel comprising an air outlet;

the plurality of blades each comprises a metal frame and a plastic shell disposed on the metal frame;

two ends of the metal frame are connected to the wheel cover and the wheel disc, respectively;

a thickness of the plastic shell is variable; the metal frame is integrated with the plastic shell through injection molding;

the plastic shell is wrapped around at least a part of the metal frame;

the metal frame comprises a plurality of sheet metals having equal thickness; the metal frame comprises a central camber line A; a cross section of the plastic shell comprises a first curve and a second curve; and the first curve and the second curve are symmetrical or asymmetrical with respect to the central camber line A;

the central camber line A is a circular arc with a chord line L; and the following equation is satisfied:

$$y = \left[\left(\frac{0.5}{\frac{\sin\theta}{2}}\right)^2 - (x-0.5)^2\right]^{\frac{1}{2}} - \frac{0.5}{\frac{\tan\theta}{2}};$$

θ refers to a bending angle of the central camber line A, and x and y refer to a coordinate value of a point on the central camber line A.

6. The device of claim 5, wherein a coordinate value of a point on the first curve and the second curve are determined as follows:

the first curve:

$$\begin{cases} x_u = x - y_{ex}\sin\varphi_x \\ y_u = y + y_{ex}\cos\varphi_x \end{cases};$$

the second curve:

$$\begin{cases} x_1 = x + y_{ex}\sin\varphi_x \\ y_1 = y - y_{ex}\cos\varphi_x \end{cases};$$

where $$\varphi = \tan^{-1}\frac{dy}{dx};$$

$\varphi_x$ is an included angle between a tangent at a point on the central camber line A and an x-axis; and x and y refer to a coordinate value of a point on the central camber line A;

$x_u$ and $y_u$ refer to a coordinate value of a point on the first curve; and $x_1$ and $y_1$ refer to a coordinate value of a point on the second curve.

7. A device, comprising:

a wheel cover comprising an air inlet;

a wheel disc; and a plurality of blades disposed between the wheel cover and the wheel disc; wherein:

the wheel cover and the wheel disc each comprise a sheet metal, and the plurality of blades comprises a composite material;

the wheel disc comprises a central part and a motor mounting base disposed on the central part;

every two adjacent blades form an air channel comprising an air outlet;

the plurality of blades each comprises a metal frame and a plastic shell disposed on the metal frame;

two ends of the metal frame are connected to the wheel cover and the wheel disc, respectively;

a thickness of the plastic shell is variable; the metal frame is integrated with the plastic shell through injection molding;

the plastic shell is wrapped around at least a part of the metal frame;

the metal frame comprises a plurality of sheet metals having equal thickness; the metal frame comprises a central camber line A; a cross section of the plastic shell comprises a first curve and a second curve; and the first curve and the second curve are symmetrical or asymmetrical with respect to the central camber line A;

the central camber line A comprises a plurality of circular arcs, with a chord line L; and the following equation is satisfied:

$$x \le 0.45,\ y = \left[\left(\frac{0.45}{\sin(0.6\theta)}\right)^2 - (x-0.45)^2\right]^{\frac{1}{2}} - \frac{0.45}{\tan(0.6\theta)};$$

$$x > 0.45,\ y = \left[\left(\frac{0.55}{\sin(0.4\theta)}\right)^2 - (x-0.45)^2\right]^{\frac{1}{2}} - \frac{0.55}{\tan(0.4\theta)};$$

θ refers to a bending angle of the central camber line A, and x and y refer to a coordinate value of a point on the central camber line A.

8. The device of claim 7, wherein a coordinate value of a point on the first curve and the second curve are determined as follows:

the first curve:

$$\begin{cases} x_u = x - y_{ex}\sin\varphi_x \\ y_u = y + y_{ex}\cos\varphi_x \end{cases};$$

the second curve:

$$\begin{cases} x_1 = x + y_{ex}\sin\varphi_x \\ y_1 = y - y_{ex}\cos\varphi_x \end{cases};$$

where $$\varphi = \tan^{-1}\frac{dy}{dx};$$

$\varphi_x$ is an included angle between a tangent at a point on the central camber line A and an x-axis; and x and y refer to a coordinate value of a point on the central camber line A;

$x_u$ and $y_u$ refer to a coordinate value of a point on the first curve; and $x_1$ and $y_1$ refer to a coordinate value of a point on the second curve.

9. A device, comprising:

a wheel cover comprising an air inlet;

a wheel disc; and a plurality of blades disposed between the wheel cover and the wheel disc; wherein:

the wheel cover and the wheel disc each comprise a sheet metal, and the plurality of blades comprises a composite material;

the wheel disc comprises a central part and a motor mounting base disposed on the central part;

every two adjacent blades form an air channel comprising an air outlet;

the plurality of blades each comprises a metal frame and a plastic shell disposed on the metal frame;

two ends of the metal frame are connected to the wheel cover and the wheel disc, respectively;

a thickness of the plastic shell is variable; the metal frame is integrated with the plastic shell through injection molding;

the plastic shell is wrapped around at least a part of the metal frame;

the metal frame comprises a plurality of sheet metals having equal thickness; the metal frame comprises a central camber line A; a cross section of the plastic shell comprises a first curve and a second curve; and the first curve and the second curve are symmetrical or asymmetrical with respect to the central camber line A;

the central camber line A is a parabola with a chord line L, and the following equation is satisfied:

$$\frac{1}{y} = \frac{\cot(0.6\theta)}{x} - \frac{\cot(0.4\theta)}{1-x};$$

where θ refers to a bending angle of the central camber line A, and x and y refer to a coordinate value of a point on the central camber line A.

10. The device of claim 9, wherein a coordinate value of a point on the first curve and the second curve are determined as follows:

the first curve:

$$\begin{cases} x_u = x - y_{ex}\sin\varphi_x \\ y_u = y + y_{ex}\cos\varphi_x \end{cases};$$

the second curve:

$$\begin{cases} x_1 = x + y_{ex}\sin\varphi_x \\ y_1 = y - y_{ex}\cos\varphi_x \end{cases};$$

where $$\varphi = \tan^{-1}\frac{dy}{dx};$$

$\varphi_x$ is an included angle between a tangent at a point on the central camber line A and an x-axis; and x and y refer to a coordinate value of a point on the central camber line A;

$x_u$ and $y_u$ refer to a coordinate value of a point on the first curve; and $x_1$ and $y_1$ refer to a coordinate value of a point on the second curve.

* * * * *